United States Patent [19]

Landsverk

[11] Patent Number: 4,535,984

[45] Date of Patent: Aug. 20, 1985

[54] SUPPORT APPARATUS

[76] Inventor: James B. Landsverk, 6893 8th St. North, St. Paul, Minn. 55119

[21] Appl. No.: 515,778

[22] Filed: Jul. 21, 1983

[51] Int. Cl.[3] ..... A63B 69/00; A47F 5/08

[52] U.S. Cl. ..... 272/78; 108/149; 211/162; 182/36

[58] Field of Search ..... 272/77–78, 272/113, 109; 108/137, 143, 149; 248/323, 317, 327, 243; 211/113, 162; 104/91, 94, 95; 182/36, 150

[56] References Cited

U.S. PATENT DOCUMENTS

| | | | |
|---|---|---|---|
| 489,750 | 1/1893 | Medart | 272/78 |
| 547,342 | 10/1895 | Foster . | |
| 658,553 | 9/1900 | McFadden . | |
| 1,260,123 | 3/1918 | Areson . | |
| 1,929,325 | 10/1933 | Masterson | 248/323 |
| 2,404,195 | 7/1946 | Schlieben | 104/91 |
| 2,587,150 | 2/1952 | Hansen et al. | 211/113 |
| 2,659,603 | 11/1953 | Glasser | 272/78 |
| 2,729,411 | 1/1956 | Cahill . | |
| 3,411,497 | 11/1968 | Rickey et al. . | |
| 4,050,693 | 9/1977 | Lichterman . | |

FOREIGN PATENT DOCUMENTS

| | | | |
|---|---|---|---|
| 18305 | of 1910 | United Kingdom | 272/78 |
| 1045379 | 10/1966 | United Kingdom | 211/113 |

*Primary Examiner*—Richard J. Apley
*Assistant Examiner*—S. R. Crow
*Attorney, Agent, or Firm*—Robert C. Baker

[57] ABSTRACT

Support apparatus comprising a platform assembly suspended from above and held by two suspension assemblies which are spaced apart and parallelly oriented, each suspension assembly comprising an elongated horizontal base track means fixedly mounted to overhead ceiling means and a track follower assembly adjustably mounted to the base track means. The track follower assembly includes an elongated horizontal mating track means slidable in aligned relationship with respect to the base track means and supported by the base track means in that aligned relationship. Additionally, the track follower assembly includes means for maintaining the mating track means against tilt elevational movement with respect to the base track means, plus strut means affixed to the mating track means in vertically depending relationship therefrom. The platform assembly is adjustably affixed to the strut means. The platform assembly may support a variety of elements, including a speed bag platform and depending speed bag.

7 Claims, 4 Drawing Figures

Fig. 2.
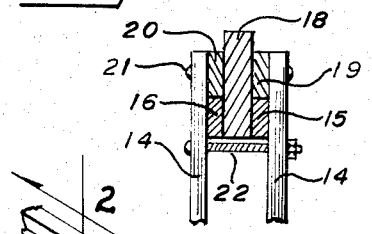
Fig. 3.
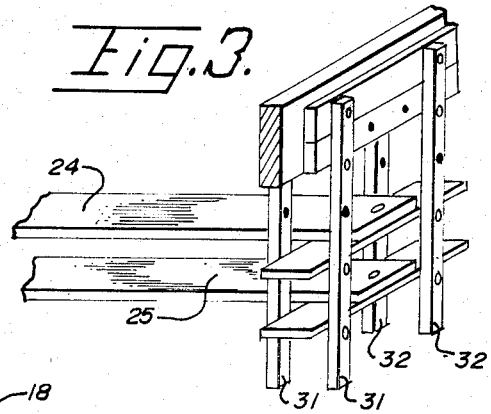
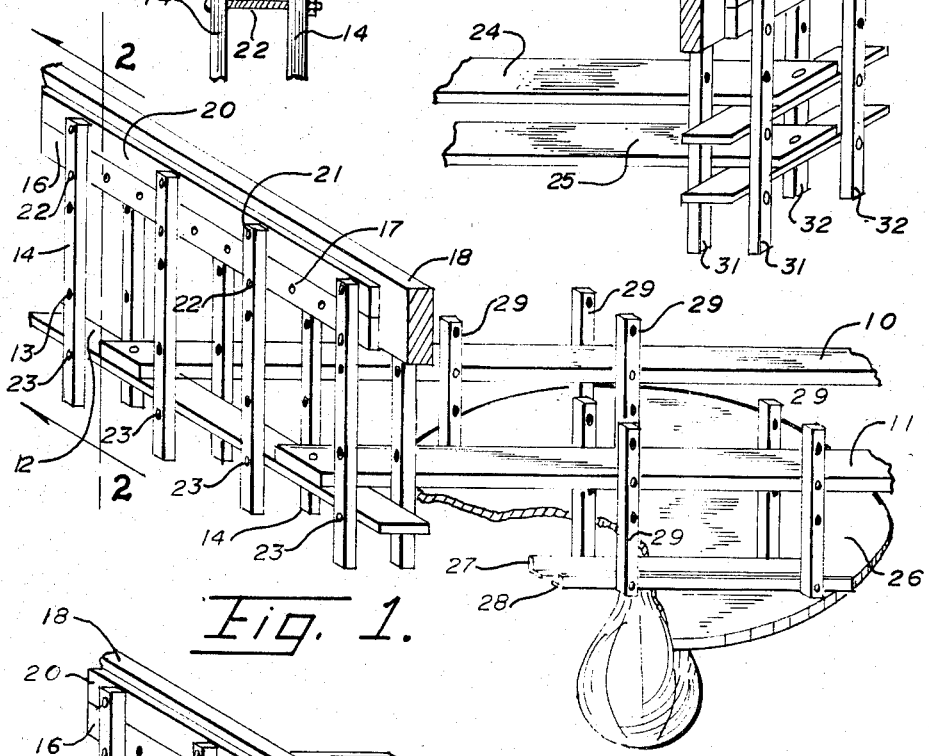
Fig. 1.
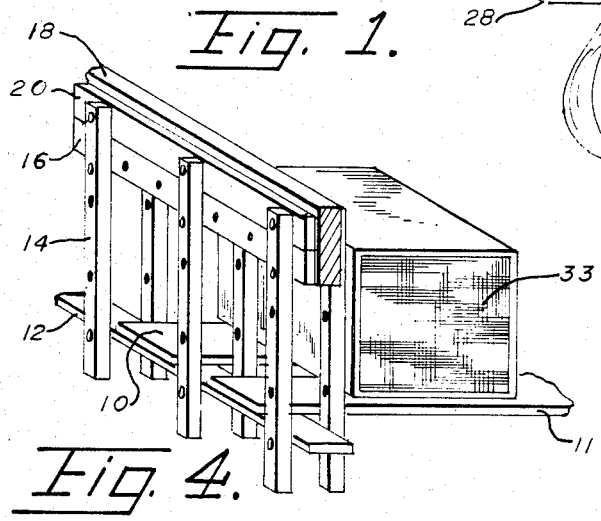
Fig. 4.

SUPPORT APPARATUS

BACKGROUND OF THE INVENTION

This invention relates to support apparatus, and more particularly to support apparatus of a suspended nature and of high stability.

Among other things, the support apparatus of the invention is useful to support a speed bag. Speed bags are also commonly known as punching bags or strike bags. Additionally, however, the support apparatus of the invention is useful to support shelving as well as cabinets or other structures for storage or placement of various components.

While support apparatus suspended from an overhead structure has heretofore been proposed, none is known which incorporates the advantageous features of my invention, particularly the great adjustability and removability of my suspended portion in combination with substantial immobility for my suspended removable portion as the same is suspended for use.

SUMMARY OF THE INVENTION

The support apparatus of this invention comprises a platform assembly suspended from above and held by two suspension assemblies which are spaced apart and parallelly oriented. Each suspension assembly comprises a fixed part and an adjustable part. The fixed part is appropriately characterized as an elongated horizontal base track means fixedly mounted to an overhead ceiling means.

The removable part is appropriately characterized as a track follower assembly adjustably mounted or mountable to the base track means. The track follower assembly includes elongated horizontal mating track means slidable in aligned relationship with respect to the base track means and supported by the base track means in the aforesaid aligned relationship. Additionally, the track follower assembly includes means for maintaining the mating track means against tilt elevational movement with respect to the base track means. Still further, strut means are affixed to the mating track means in vertically depending relationship therefrom. The platform assembly is adjustably affixed to the strut means.

Illustratively, each base track means preferably comprises an inner and outer base track means affixed on opposite sides of a horizontal overhead beam. Each mating track means in this embodiment comprises an inner and outer mating track member slidable in mating relationship with respect to the inner and outer base track members. Preferred strut means comprise plural strut members in opposing paired relationship depending from the inner and outer mating track members. A preferred means for preventing tilt elevational movement of the adjustable and removable track follower assembly is that of a connecting member between opposing strut members and located adjacent to the underside of the overhead or ceiling beam. Ideally, the connecting member also functions as a clamp or a clamplike means to maintain the mating track members non-slidable and even immovable with respect to the base track of the structure.

The platform assembly of the invention may in fact comprise shelving. Further, however, the platform assembly may consist essentially of nothing more than horizontal support members, even members which are spaced apart as distinct from a solid continuous platform assembly.

Still further, the main platform assembly may provide the mounting base for a speed bag or punching bag platform, including an adjustable mounting for the speed bag platform in depending relationship from the main platform assembly. A speed bag or punching bag is mounted to depend from the speed bag platform.

BRIEF DESCRIPTION OF THE DRAWING

FIG. 1 is a schematic perspective view of the support apparatus of the invention with parts broken away and with the entire right suspension assembly omitted because it is but a mirror image of the left suspension assembly shown in FIG. 1;

FIG. 2 is a fragmentary cross section of the relationship between inner and outer base track members and inner and outer mating track members, taken on line 2—2 of FIG. 1;

FIG. 3 is a schematic perspective view of support apparatus according to the invention, with plural platforms employed as shelving, and with the left suspension assembly omitted since it is but a mirror image of the right suspension assembly shown in FIG. 3; and FIG. 4 is also a schematic perspective view of support apparatus according to the invention with a single main platform for supporting a cabinet, and with the right suspension assembly omitted since it is but a mirror image of the left one shown in the Figure.

DESCRIPTION OF THE PREFERRED EMBODIMENT

Referring to the drawing, particularly FIG. 1, the first main feature of the invention that will be described is the platform assembly, sometimes called herein the "main" platform assembly. The platform assembly illustrated in FIG. 1 consists of two transverse board members 10 and 11. They are spaced apart and therefore do not form a continuous platform. They are supported at their ends by aligned parallel boards or beams and the left board shown in FIG. 1 is given the reference character 12. The left aligned board 12 is in turn mounted upon vertical struts for adjustability along the length of the vertical struts in a manner to be hereinafter described. The important thing to recognize at this point is that the platform assembly 10, 11 is suspensed from above and held by two suspension assemblies, only the left one of which is illustrated in FIG. 1.

Each suspension assembly may be considered as having a fixed portion and a movable portion.

The fixed portion of each suspension assembly is that of an elongated horizontal base track means fixedly mounted to overhead ceiling means. Referring particularly to FIGS. 1 and 2, the back track means preferably comprises an inner 15 and outer 16 base track member or board permanently affixed, such as by nails 17, on opposite sides of a horizontal beam 18 such as an overhead beam or joist of a basement ceiling. To be emphasized, however, is that a beam or equivalent of any other ceiling structure is equally suitable for the formation of the composite elongated horizontal base track means. Further, the beam 18 and side tracks 15 and 16 may comprise a unitary structure which may be then mounted or affixed to a ceiling, including a flat ceiling. In essence, each base track means actually includes dual tracks 15 and 16. Further to be emphasized is that the composite base track means on the left as illustrated in FIG. 1 is parallel and spaced apart from the base track means on the right (not shown in FIG. 1).

A track follower assembly is adjustably mounted to each base track means. The nature of the track follower assembly is such that it includes elongated horizontal mating track means slidably in aligned relationship with respect to the base track means and supported by the base track means. Illustratively, the mating track means preferably comprises an inner 19 and outer 20 mating track member or beam slidable in mating relationship or cooperative relationship upon the inner 15 and outer 16 dual base track members.

Permanently affixed to the mating track means are the vertically depending strut members 14. For example, the inner 19 and outer 20 mating track members each have vertically depending struts 14 permanently fixed to them as by any suitable means such as bolts 21. The vertical strut means suitably comprises a plurality of vertical strut members 14 in opposing paired relationship, as illustrated. Each vertical strut member 15 may suitably consist of a square tubing, such as a tubing of aluminum or other metal. However, struts of other material may be employed. Importantly from the standpoint of adjustability for the base or main platform assembly (composed of boards 10 and 11 supported on end boards such as board 12), each strut 14 is suitably provided with bolt openings 13 or other fastener reception means in spaced relationship along the vertical length thereof, with the openings at various horizontal levels being aligned horizontally. Further to be observed is that each strut 14 is provided with a bolt opening or equivalent connector site at a location such that a connecting member (such as a bolt 22) may extend between the inner and outer struts 14 of an opposing pair at a location adjacent to the underside of overhead beam 18. Optionally, only one such pair of opposing strut members may be provided with such a bolt opening for a connecting rod or bolt 22 at a location adjacent to the underside of the overhead beam 18. This is true especially where one chooses to employ such a connecting member 22 between an opposing pair of struts 14 located medially between the ends of the mating track members 19 and 20. Such a connecting member 22 prevents tilt elevational movement of the entire track follower assembly consisting of the mating track means 19, 20 and depending struts 14. Additional such connecting members may however be employed advantageously; and a suitable and preferred approach is to employ a connecting member such as bolt 22 between the opposing pair of struts 14 at each end of the plurality of strut members along the mating track members 19 and 20.

To be emphasized is that by employing a plurality of bolt holes or openings in the strut members 14, with the holes at any one level in horizontal alignment, ready adjustability of the vertical level of the main or base platform assembly may be accomplished. For example, bolts 23 extend through end board 12 to which platform boards 10 and 11 are bolted or otherwise fastened. Easy adjustment of the level of the platform is accomplished by shifting the level of bolts 23 to a different set of horizontally aligned bolt openings in struts 14. Further, as particularly illustrated schematically in FIG. 3, bolt openings at various levels permit ready addition of platforms or platform assemblies in the nature of shelving, such as shelves 24 and 25.

An interesting feature of the invention, particularly with respect to the connecting members or bolts 22 lying adjacent the underside of the overhead beam, is that with respect to the extraordinary stability or rigidity which may be imparted to the entire track follower assembly of mating track means, 19, 20 and depending struts 14, and thus for the platform assembly also. Despite the fact that the entire track follower assembly and platform are readily removable and separable from the horizontal base track means at one's option, the connectors 22 function in cooperation with the mating track members 19 and 20 and the base track members 15 and 16 to impart great stability and rigidity and immobility to the removably suspended elements of the apparatus. The connecting members such as bolts 22 may be conveniently and easily tightened so as to apply pressure to hold the track follower assembly as a composite against the base track means. This feature is especially advantageous from the standpoint of versatile use of the platform assembly without danger of having it tilt or shift while moving anything on it or suspended from it. In a significant sense, the dual mating track members and paired struts thus work together in a clamplike fashion to hold the suspended struts and platform in a fixed condition against mobility.

As particularly illustrated in FIG. 1, the platform assembly held against mobility as aforediscussed provides a convenient base on which to mount a speed bag platform 26 of circular nature. Illustratively, this may be accomplished by affixing spaced parallelly aligned angle irons (such as the pair 27 and 28) to the upper surface of a speed bag platform 26 and affixing to the angle irons suitable strut members 29 (illustratively square tubing) which are bolted to transverse boards 10 and 11 of the platform assembly. A speed bag or punching bag 30 then is suspended in suitable known manner from the speed bag platform to provide a complete assembly of high stability and nevertheless ready adjustability in height as desired by a user.

If desired, as specially illustrated in FIG. 3, only two pairs of opposing depending strut members 31 and 32 may be employed where the support requirements are relatively limited as in the case of forming plural platforms 24 and 25 to be used for shelving. While only the right suspended assembly is illustrated in the showing of FIG. 3, it is in all respects comparable to the left suspended assembly illustrated in FIG. 1 except for the reduction of the depending struts to two pairs 31 and 32.

The showing in FIG. 4 is in all respects comparable to the showing of FIG. 1 except for the fact that the platform assembly consisting of boards 10 and 11 is employed for the purpose of supporting a cabinet 33. For purposes of brevity, common numbering is employed for the elements in FIG. 4 to that numbering employed for comparable elements in FIG. 1.

The foregoing description is intended to be illustrative and not limitative of the invention, which may be embodied in other specific forms without departing from its essential attributes. In this respect the claims appended hereto are intended to be construed as broadly as consistent with their validity.

That which is claimed is:

1. Support apparatus comprising a platform assembly suspended from above and held by two suspension assemblies, said suspension assemblies being spaced apart and parallelly oriented, each said suspension assembly comprising:

a. elongated horizontal base track means of uniform cross-section throughout the entire length thereof, said base track means being fixedly mounted to overhead ceiling means, and b. a track follower assembly adjustably mounted to said base track means, said track follower assembly including elongated horizontal mating track means of uniform cross-section throughout the entire length thereof, said mating track means being substantially equal in length to said base track means and being slidable in aligned relationship with respect to said base track means and supported by said base track means in said aligned relationship, means for maintaining said mating track means against tilt elevational movement with respect to said base track means, and at least two strut means affixed to said mating track means in vertically depending relationship therefrom and in spaced relationship along the length thereof, said platform assembly being adjustably affixed to said strut means.

2. The support apparatus of claim 1 wherein said platform assembly comprises shelving.

3. The support apparatus of claim 1 wherein said base track means comprises an inner and outer base elongated track member affixed on opposite sides of a horizontal beam, wherein said mating track means comprises an inner and outer elongated mating track member slidable in mating relationship with respect to said inner and outer base track members, wherein said strut means comprises plural strut members in opposing paired relationship depending from said inner and outer mating track members, and wherein said means for maintaining said mating track means against tilt elevational movement comprises a connecting member between an opposing pair of strut members and located adjacent to the underside of said beam.

4. The support apparatus of claim 3 wherein said connecting member functions as a clamp to maintain said mating track means non-slidable with respect to said base track means.

5. The support apparatus of claim 3 additionally comprising a speed bag platform adjustably mounted in depending relationship from said platform assembly, and a speed bag depending from said speed bag platform.

6. Support apparatus comprising:

a. parallel spaced apart first and second elongated horizontal base track means of uniform cross-section throughout the entire length thereof, said base track means being fixedly mounted to overhead ceiling means, b. first and second track follower assemblies adjustably mounted respectively to said first and second base track means, each said track follower assembly including elongated horizontal mating track means of uniform cross-section throughout the entire length thereof, said mating track means being substantially equal in length to said base track means and being slidable in aligned relationship with respect to said base track means and supported by said base track means in said aligned relationship, means for maintaining said mating track means against tilt elevational movement with respect to said base track means, and at least two strut means affixed to each said mating track means in vertically depending relationship therefrom and in spaced relationship along the length thereof, and c. a suspended horizontal platform assembly adjustably fixed to and supported by said strut means.

7. Support apparatus comprising a platform assembly suspended from above and held by two suspension assemblies, said suspension assemblies being spaced apart and parallelly oriented, each said suspension assembly comprising:

a. elongated horizontal base track means fixedly mounted to overhead ceiling means, said base track means comprising inner and outer base track members affixed on opposite sides of a horizontal beam, and b. a track follower assembly adjustably mounted to said base track means, said track follower assembly including inner and outer elongated horizontal mating track members slidable in aligned mating relationship with respect to said inner and outer base track members and supported by said base track members in said aligned relationship, means for maintaining said mating track means against tilt elevational movement with respect to said base track means, and plural strut members in opposing paired relationship fixed to and depending vertically from said inner and outer mating track members, said means for maintaining said mating track means against tilt elevational movement comprising a connecting member between an opposing pair of strut members and located adjacent to the underside of said beam and functioning as a clamp to maintain said mating track means non-slidable with respect to said base track means, said platform assembly being adjustably affixed to said strut means.

* * * * *

UNITED STATES PATENT AND TRADEMARK OFFICE

CERTIFICATE OF CORRECTION

PATENT NO. : 4,535,984

DATED : August 20, 1985

INVENTOR(S) : J.B. Landsverk

It is certified that error appears in the above—identified patent and that said Letters Patent is hereby corrected as shown below:

In the Specification:

Col. 1, line 48, delete "means" and insert --member--.

Col. 3, line 20, delete "15" and insert --14--.

Signed and Sealed this

*Tenth* Day of *December 1985*

[SEAL]

*Attest:*

DONALD J. QUIGG

*Attesting Officer*

*Commissioner of Patents and Trademarks*